US006013794A

United States Patent [19]

Nyqvist

[11] Patent Number: 6,013,794

[45] Date of Patent: Jan. 11, 2000

[54] METHOD OF WORKING UP MIXED EXPLOSIVES

[75] Inventor: Jan-Olof Nyqvist, Karlskoga, Sweden

[73] Assignee: Bofors Explosives AB, Karlskoga, Sweden

[21] Appl. No.: 08/875,389

[22] PCT Filed: Dec. 22, 1995

[86] PCT No.: PCT/SE95/01567

§ 371 Date: Sep. 29, 1997

§ 102(e) Date: Sep. 29, 1997

[87] PCT Pub. No.: WO96/23196

PCT Pub. Date: Aug. 1, 1996

[30] Foreign Application Priority Data

Jan. 27, 1995 [SE] Sweden ..... 9500280

[51] Int. Cl.[7] ..... C07D 257/02; C07D 251/00

[52] U.S. Cl. ..... 540/475; 149/92; 149/109.6; 149/124; 540/475; 544/215

[58] Field of Search ..... 149/92, 109.6, 149/124; 540/475; 544/215

[56] References Cited

U.S. PATENT DOCUMENTS

| | | | |
|---|---|---|---|
| 4,389,265 | 6/1983 | Tompa et al. | 149/109.6 |
| 4,638,065 | 1/1987 | Svensson et al. | 544/196 |
| 4,909,868 | 3/1990 | Melvin | 149/109.6 |
| 5,284,995 | 2/1994 | Melvin | 558/203 |

FOREIGN PATENT DOCUMENTS 42 37 580 3/1994 Germany .

*Primary Examiner*—Peter O'Sullivan
*Attorney, Agent, or Firm*—Pollock, Vande Sande & Amernick

[57] ABSTRACT

The present invention relates to a method of working up and recovering returned explosives which are principally of the military type and which contain both fusible and non-fusible crystalline substances. In accordance with the invention, the returned explosive is treated in a multi-stage process which includes a first leaching stage for removing the non-crystalline, preferably fusible, component of the explosive in the form of trotyl, wax or plastic. The substance used in the leaching stage, principally toluene, does not affect the crystalline components of the explosive. The collected leaching liquid is separated off and the toluene, together with its dissolved content of trotyl or wax, is conveyed onwards for working up. The toluene which is recovered during the working up is returned to the process while the remaining filtrate from the filtration stage is treated with solvent which dissolves the crystalline high-energy explosives octagen and hexagen, respectively, which are relevant in this connection, which explosives, in a subsequent process stage, are precipitated out in the form of new crystals which, after a possible recrystallization, are ready to be reused. The solvent which is used in this connection is returned to the process.

27 Claims, 6 Drawing Sheets

FLOW DIAGRAM FOR LEACHING STAGE 1.

FLOW DIAGRAM FOR RECRYSTALLIZATION STAGE 3.

FLOW DIAGRAM FOR WORKING UP BLO/NMP STAGE 5:2

FLOW DIAGRAM FOR WORKING UP BLO/NMP STAGE 5:2

METHOD OF WORKING UP MIXED EXPLOSIVES

FIELD OF THE INVENTION

The present invention relates to a complete process for working up returned and residual explosives which contain both fusible binders and crystalline high-energy explosives.

BACKGROUND OF THE INVENTION

Previously, no useful processes have been available for working up mixed explosives which are relevant in this present case. As a result, residual and returned quantities of these explosives have regularly been sent for destruction. By contrast, residual and returned quantities of pure trotyl explosives have been reused to a substantial degree.

SUMMARY OF THE INVENTION

The object of the invention is to provide a process for working up mixed explosives of the above-mentioned types with the intention of enabling at least the most valuable of the components contained therein, namely the crystalline high-energy explosives octagen and hexagen, to be reused. An additional advantage of the novel process is, furthermore, that it is also the octagen and hexagen, whose manufacture results in the greatest degree of environmental pollution.

In addition, the novel process enjoys the advantage that solvents which are used in it are, processed in accordance with constituent processes which are included in the invention. As a result the solvents can be circulated continuously in the main process.

Both fusible explosive binders such as trotyl and other non-explosive binders of the wax or plastic type can be included in the mixed explosives which are relevant in connection with the present invention.

The crystalline high-energy explosives which are relevant in this context consist, as has already been mentioned, of the related nitramines octagen and hexagen. As a rule, octagen and hexagen are used separately. However hexagen, since it and octagen are prepared by what is, in principle the same synthesis, can be present as an impurity, particularly in somewhat older octagen batches. This is, per se, a complication when reusing octagen since there are currently strict standards for the lowest content of hexagen in newly manufactured octagen-containing products. While the novel process does not reduce the quantities of residual product which have to be destroyed to zero, it does represent a clear improvement as compared with the previous technology, when everything was sent for destruction.

The mixed explosives which will probably in the main be relevant in connection with the novel process are octol and hexotol, i.e. octagen together with trotyl as binder and hexagen together with trotyl as binder, respectively, and also compressed octagen and hexagen products containing wax or plastic as binder.

The novel process is defined in the subsequent patent claims and also illustrated in the form of flow diagrams in the attached figures. In addition, the process has, in all its stages, been illustrated by a number of constituent examples.

That which follows provides a general description of the process in all its different stages.

BRIEF DESCRIPTION OF THE DRAWINGS

The flow diagrams elucidate the following different parts and steps of the invention.

DESCRIPTION OF THE INVENTION

Figure 1:
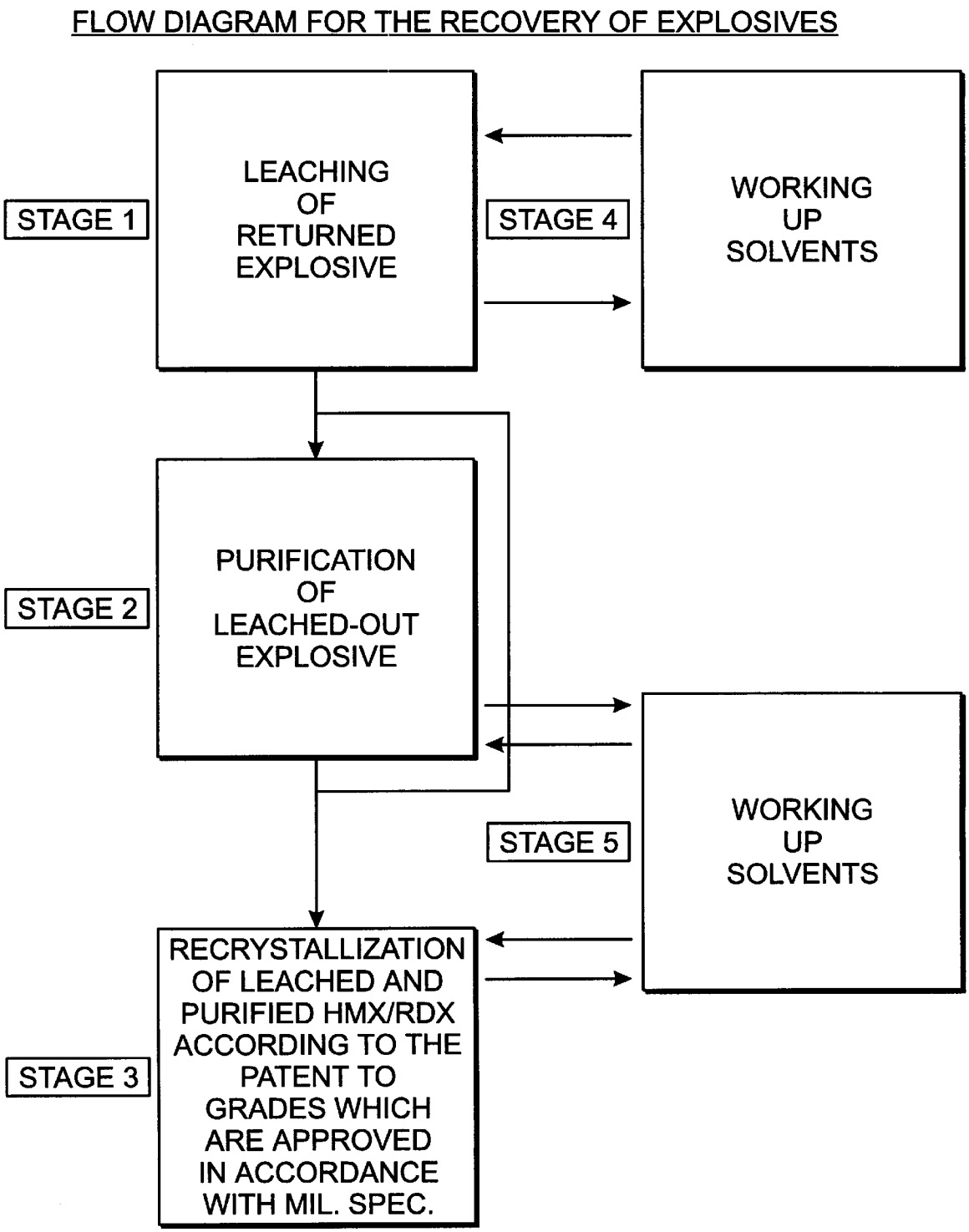
FIG. 1 represents a flow diagram for the recovery of explosive.
Figure 2:
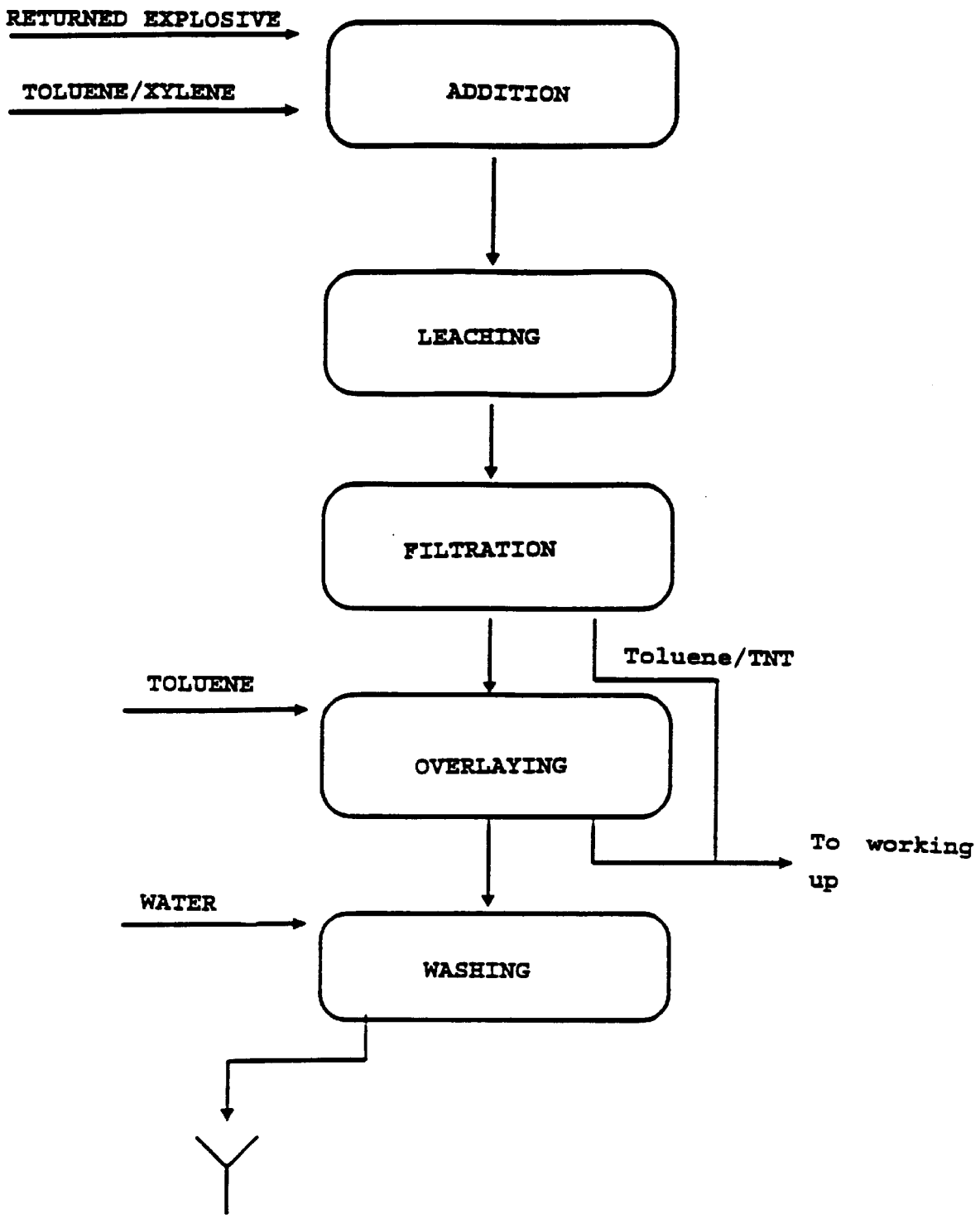
FIG. 2 represents a flow diagram for leaching stage 1.
Figure 3:
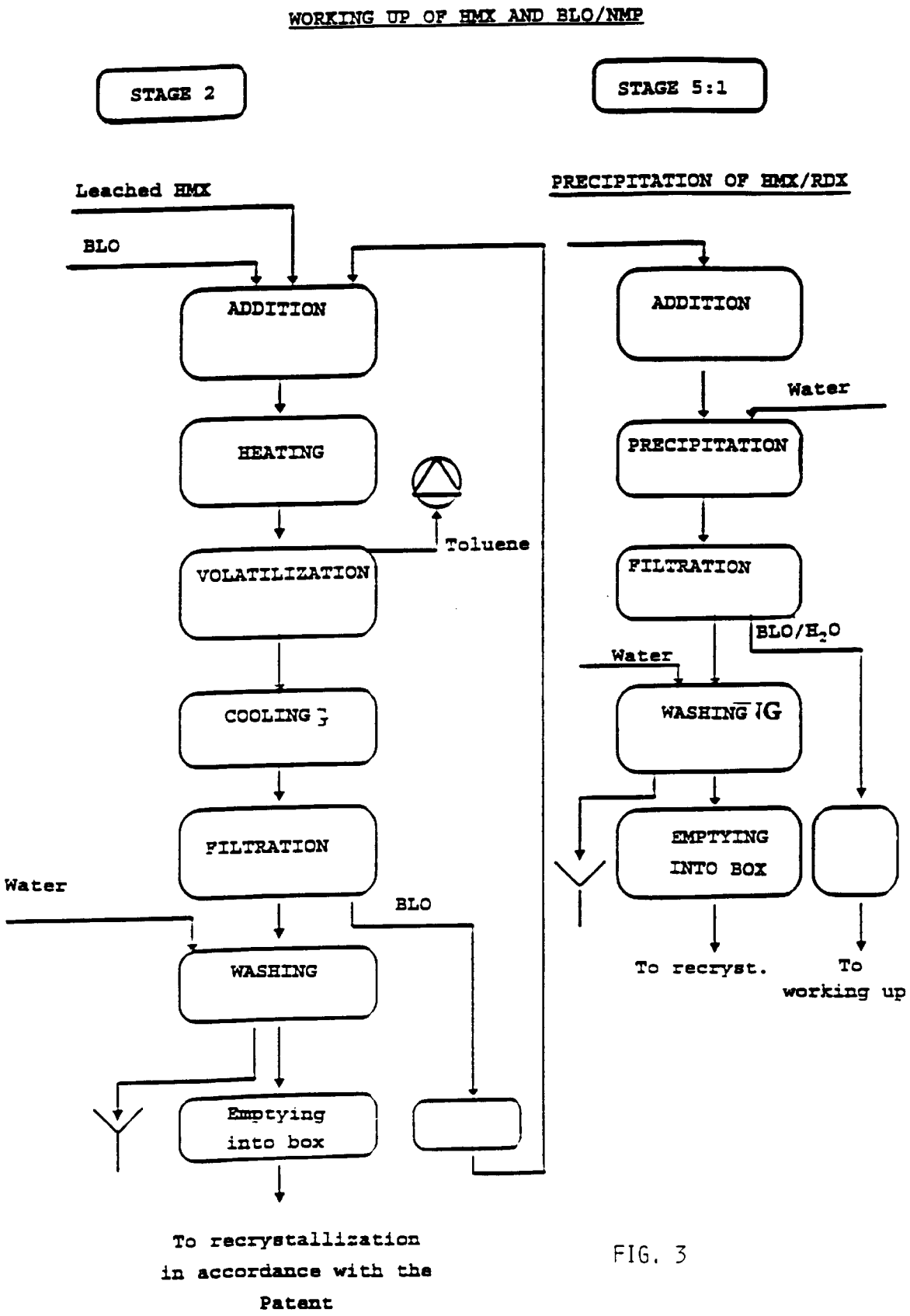
FIG. 3 represents a flow diagram illustrating the working up of HMX and BLO/NMP.
Figure 4:
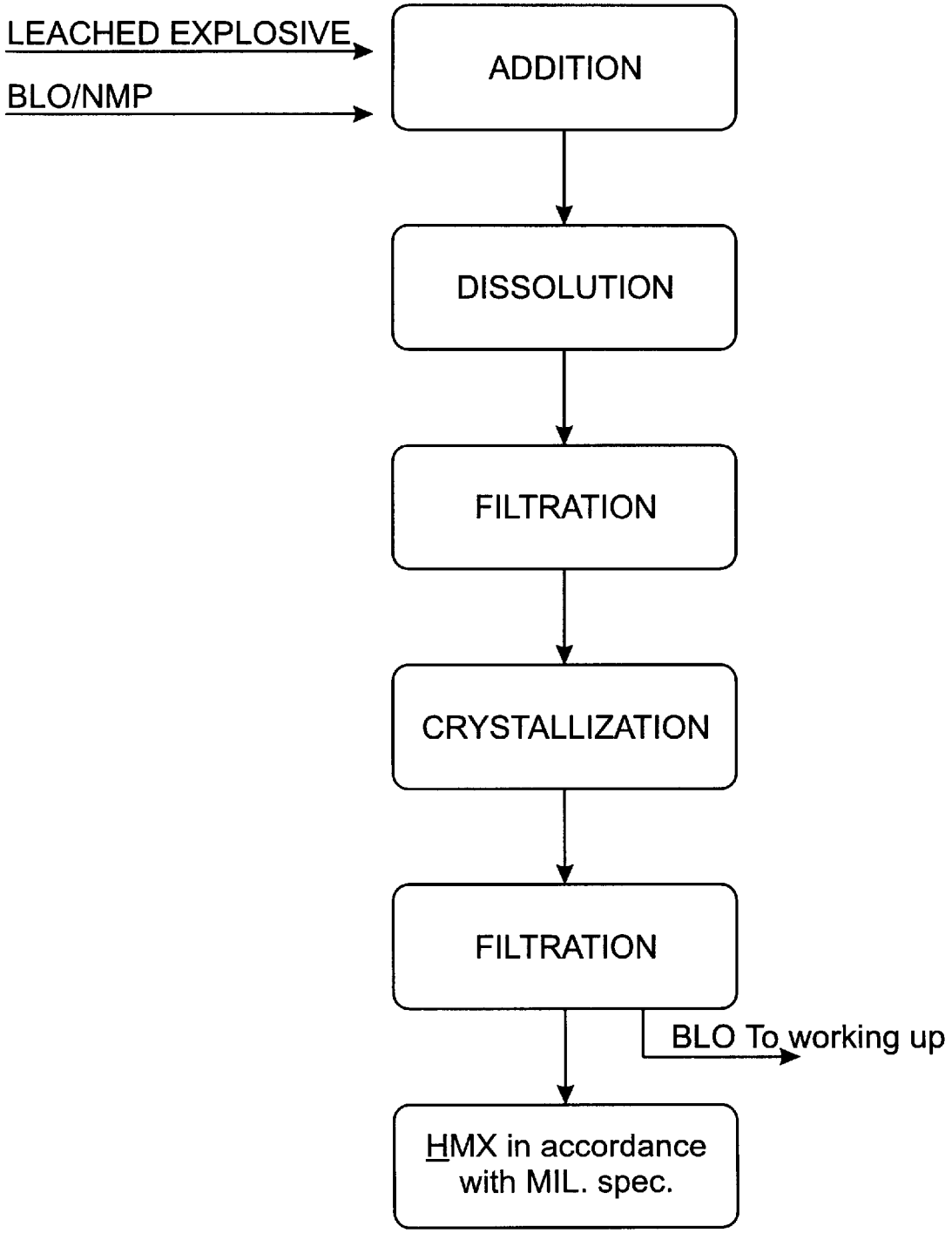
FIG. 4 represents a flow diagram for recrystallization stage 3.
Figure 5:
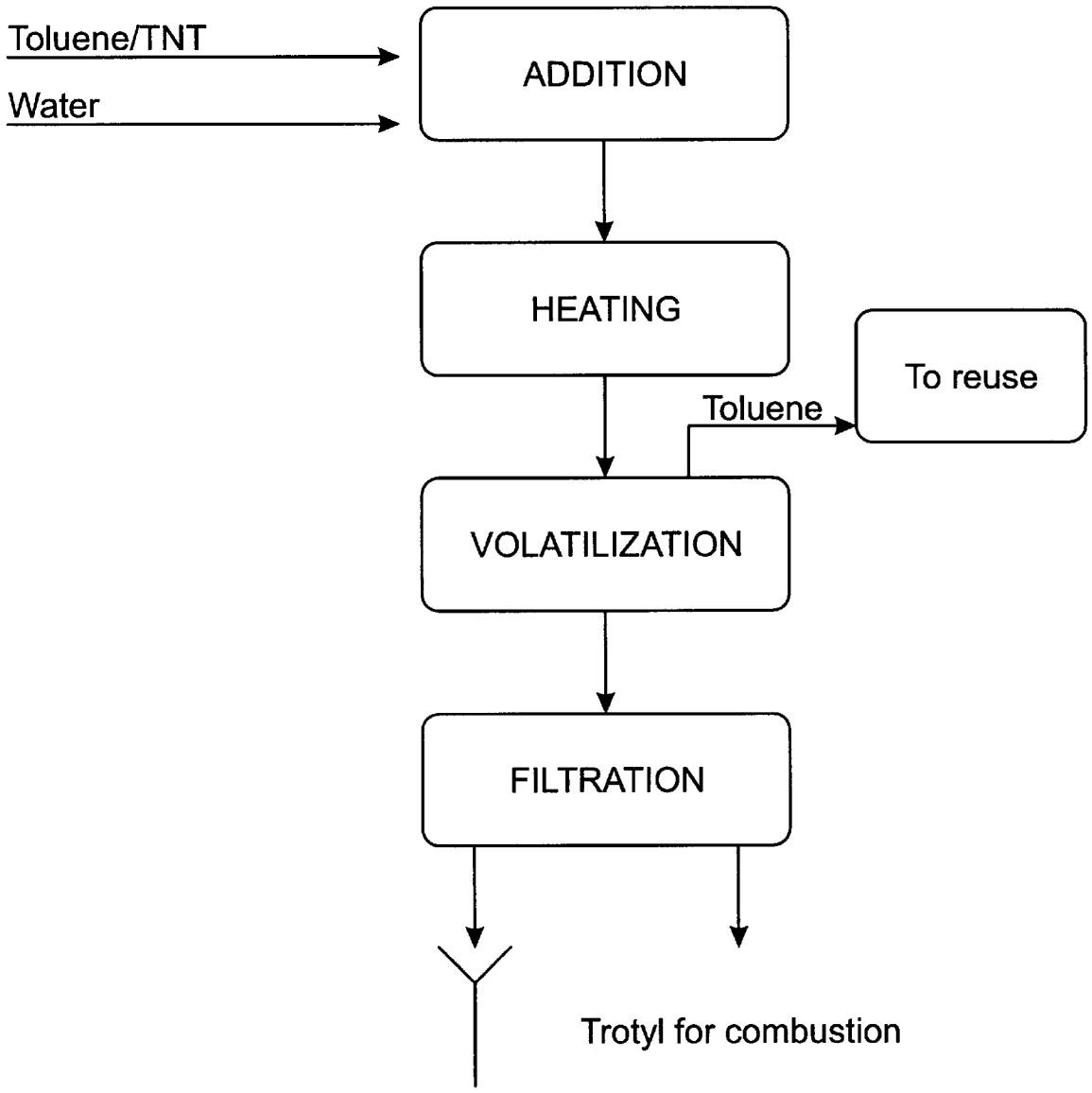
FIG. 5 represents a flow diagram for working up BLO/NMP stage 5:2.
Figure 6:
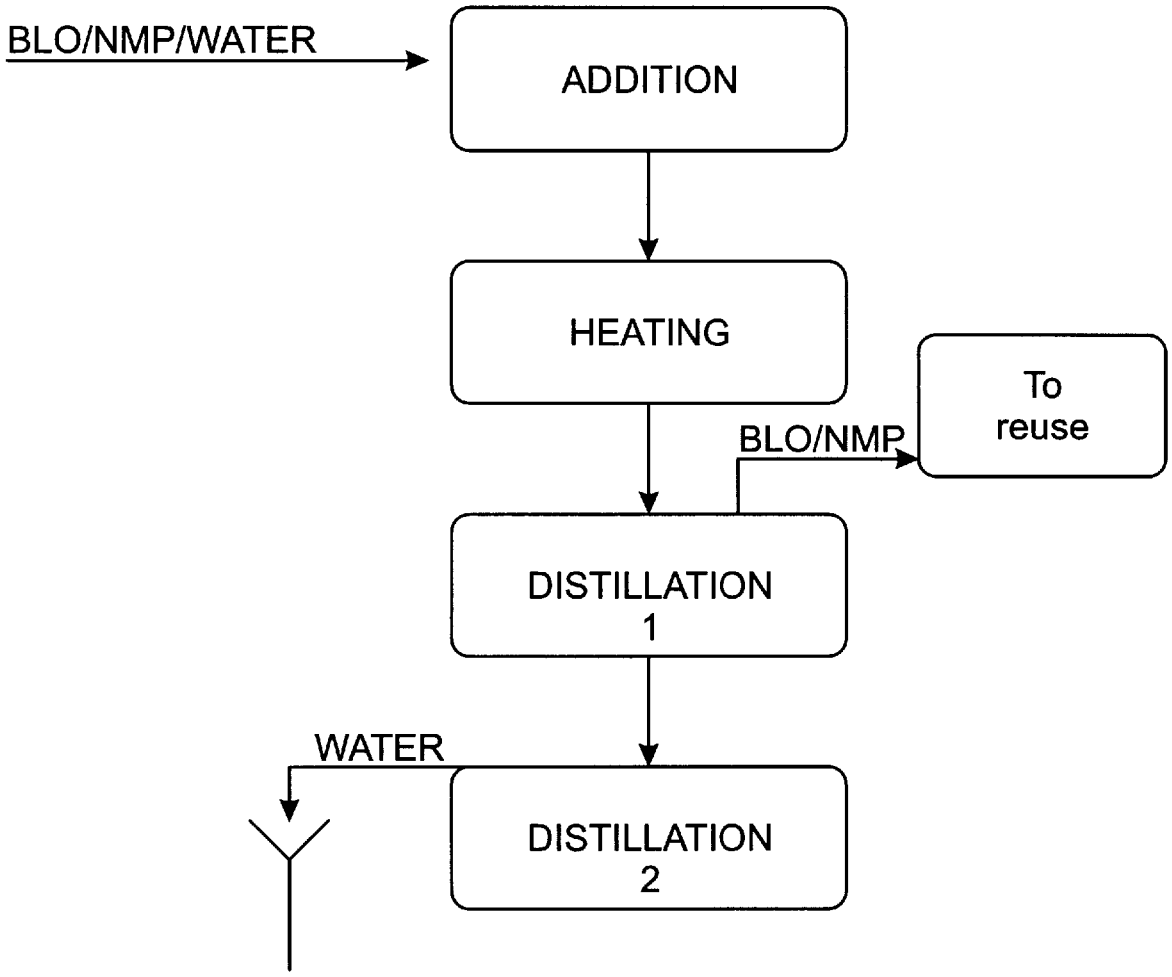
FIG. 6 represents a flow diagram for working up BLO/NMP stage 5:2.

In accordance with the present invention, the first treatment stage (stage 1) involves a leaching of the starting substance, which can be residues from ongoing production or returned products from different types of fallen ammunition. The leaching is carried out using a solvent which is suited to the relevant binder.

While the leaching normally takes place at room temperature, an elevated temperature can be required, principally in connection with compressed products of the abovementioned type. Toluene and xylene, in particular, are suitable for this purpose. However, there are also other solvents which fulfill the main requirements which are relevant in this context, namely exhibiting a sufficiently high degree of solubility for the binders which are present, while exhibiting the lowest possible degree of solubility for nitramines.

After having filtered off the solvent with binder dissolved in it, and, where appropriate, having washed the solid residual product, the remainder is a solid product which consists of the whole of the nitramine content of the original mixed explosive.

If the nitramine in question consists of octagen and it is not known how much hexagen this octagen might contain, or if it is already evident from the start that the octagen does not meet current standards, an additional leaching stage is then required in order to remove contaminating quantities of hexagen. The effectiveness of this leaching stage is based on the appreciably higher solubility of the hexagen in at least some solvents. In the leaching stage, all the hexagen is dissolved, at an elevated temperature, preferably greater than 105° C., in a solvent which is suitable for the purpose, such as gamma-butyrolactone (BLO) or N-methyl-2-pyrrolidone (NMP). Any toluene and water residues which remain from the preceding leaching stage are also removed in connection with increasing the temperature to the above-mentioned elevated temperature, which is, in turn, clearly advantageous. While a dissolution temperature on the order of approximately 105° C. does not dissolve the octagen completely, the hexagen is completely dissolved at this temperature. Once all the hexagen has been dissolved, the temperature of the mother liquor is lowered to a point at which virtually all the previously dissolved octagen has precipitated out in crystalline form while all the hexagen is still present in solution. A pure crystalline octagen, whose crystal form does not meet current requirements, is obtained as a residue by filtering the resulting mother liquor. In order to obtain octagen of the desired particle size, a recrystallization stage is required in which the same solvents are used as in the previously mentioned second leaching stage but in which the precipitation of the crystalline octagen is regulated so that the desired crystal size and form is obtained. For this purpose, the solubilizing power of the solvent can be altered both by lowering the temperature and adding water. The crystal modification (α- or β-) which is obtained has been found to depend on which solvent is used in the recrystallization, and solvents which are relevant in this context have been found to yield a β-octagen which is virtually 100% pure.

Exactly as in previous stages, the mother liquor which is obtained at this point is sent for working up so that it can subsequently be returned to the process.

The concluding recrystallization stage can be used, directly after the leaching stage, for removing the binder provided it is known either that the octagen which is contained in the residual product and returned product is completely free of hexagen or that the crystalline high-energy product consists solely of hexagen.

The process stages which remain to be discussed within the scope of the invention consist of the working up of the different solvents, in which the toluene, or, alternatively, the xylene, from the original leaching stage is worked up by being driven off from the mother liquor obtained in this stage and is then condensed and returned to the process. When the solvent is driven off, the binder precipitates out of the remaining water and can be collected for combustion.

The solvents in the form of BLO and NMP from the subsequent treatment stages are freed from remaining nitramines adding water to almost 50% by weight, whereupon all the remaining octagen or hexagen, respectively, precipitates out and can be collected, after which the solvent itself is freed from remaining water by distillation.

As has previously been mentioned, the invention has been illustrated by the attached method description, which also includes 6 pages of flow diagrams.

Description of the method for leaching returned explosive.

STAGE 1 LEACHING.

| | |
|---|---|
| Additions: | 150 liters, of toluene are added to a stirred apparatus and the stirring is started and the speed of revolution is adjusted to approximately 60 revolutions/minute. 75 kg of returned octol are added in a net basket. |
| Leaching: | While the leaching can be carried out at room temperature, it can also be carried out at higher temperatures, for example 40°. The leaching time also varies with the size of the added lumps; if, for example, the leaching takes 1 hour at 40°, it takes 2 hours at 20°, and larger lumps take a longer time to dissolve. The leaching can be regarded as being finished when there are no lumps to be seen in the slurry and when the net basket does not contain any lumps. Normally, it has been found that the leaching time is approximately 3 hours on a factory scale and at room temperature. |
| Filtration: | The filtration takes place in a usual manner with the mixture being tapped off down into a suction filter which is coupled to a vessel for collecting the leaching liquid. The leached octogen is sucked as dry as possible in order to facilitate the subsequent overlaying. The toluene/TNT liquid is sucked into a collecting tank using a membrane pump. |
| Overlaying: | The product cake (<10%) which has been sucked dry is now overlaid with 30 liters of pure toluene in order to remove the last remnants of the trotyl; this is carried out with the membrane pump being switched off so that the liquid has plenty of time to disperse within the cake. After this, as much as possible of the overlying liquid is sucked off into the collecting tank. |
| Washing: | 50 liters of cold water are now dispersed over the product cake in the same way as when overlaying and with the membrane pump being switched off. The water is then sucked off to the greatest extent possible, preferably down to a moisture content of less than 10%. Samples are taken in order to determine the trotyl content and moisture content and also the content of toluene and hexogen. |
| RESULTS: | Using an incoming composition consisting of 76.3% octogen and 23.7% trotyl, the following typical results were obtained after leaching 10 tonnes of worked-up octol: |

| | |
|---|---|
| Octogen content: | 99.39% |
| Hexogen content: | 0.61% |
| Trotyl content: | 0.03% |
| Toluene content: | 0.04% |
| Water content: | 5.9% |

STAGE 2 PURIFICATION OF LEACHED PRODUCT. (Leaching 2)

| | |
|---|---|
| | In order to achieve the purest of the grades in Mil-H-45444 (<0.2% hexogen), an additional purification step is required for the purpose of removing the hexogen which is present in the octogen (up to 1.5%) and removing the remaining toluene. This is done with the aid of solvents, in this case BLO. This additional purification is carried out principally when precipitating grades directly out of the solvent using water. |
| Additions: | 350 liters of BLO from a container located outside the factory are added to the apparatus using a membrane pump and a hose. 125 kg of leached octogen are weighed, in accordance with protocol, into a cask or barrel and added to the apparatus while stirring. |
| Heating: | The heating is regulated from the control room using a program regulator and a suitable program (up to 120° C.); the apparatus is heated with hot water. |
| Volatilization: | When the temperature has reached the programmed temperature (105° C.), it is maintained at this value so that the water and toluene vapors can escape; the boiling paint of the toluene/water azeotropic mixture is approximately 86° C. |
| Cooling: | When all the toluene/water has been volatilized and all the octogen is wholly or partially dissolved, the batch is then cooled down to 15° C., either using a cooling program or else manually. |
| Filtration: | When tapping-off, the bottom valve under the apparatus is opened and the product is tapped off down into a suction filter for separating the solvent and the explosive. The tapped-down batch has first to sediment, and, after that, the mother liquor is sucked off into an intermediate vessel so that it can be reused. |
| Washing: | The remaining octogen cake is washed with 100 liters of water, after which the cake is sucked as dry as possible, preferably to a water content of less than 10%. |
| Emptying: | The octogen in the suction filter is scooped out manually into either plastic boxes or plastic barrels in which it is then transported away for storage. |

-continued

Description of the method for leaching returned explosive.

| | |
|---|---|
| RESULTS: | Typical results from these leachings, now that we have to date purified approximately 5 tonnes, are as follows: |
| | Octogen content: 99.95% |
| | Hexogen content: 0.05% |
| | Trotyl content: 0.01% |
| | Toluene content: Not detectable |

STAGE 3
RECRYSTALLIZATION TO MIL-SPEC. GRADE AND DESIRED PARTICLE SIZE.

Recrystallization to approved grades in accordance with specification Mil-H-45444 is effected using the method described in Swedish Patent Application 8401857-1.

STAGE 4 WORKING UP THE LEACHING LIQUID.

The leaching liquid, containing up to 25% trotyl dissolved in toluene, is worked up in batches. The volatile toluene is distilled off in an apparatus provided with a stirrer.

| | |
|---|---|
| ADDITIONS: | 100 l of water and 300 liters of leaching liquid are added to the apparatus while stirring. |
| HEATING: | The mixture is heated so that the azeotropic mixture of toluene/water (86° C.) evaporates. The heating is regulated in accordance with a regulator program. |
| VOLATILIZATION: | The volatilization continues until the temperature has risen to greater than 95° C., when the volatilization is terminated. |
| FILTRATION: | The remaining spent wash consisting of water, trotyl and small quantities of toluene is tapped off, while hot, down into a water-containing suction filter while stirring; when the trotyl comes into contact with the cold water it solidifies into granules which are then easy to drain. The volatilized toluene is reused in the process. The granulated trotyl can be combusted in the customary manner. |
| RESULTS.: | >99% toluene, < 1% water. |

STAGE 5 WORKING UP THE BLO/NMP.

1. PRECIPITATING THE EXPLOSIVE FROM TKE BLO/NMP

| | |
|---|---|
| Additions: | 250 liters of BLO/NMP mother liquor from a container located outside the factory are added to the apparatus using a membrane pump. The speed of revolution of the stirrer is adjusted to 100 rpm. |
| Precipitation: | 250 liters of water are sluiced down into the apparatus in ordered to precipitate the explosive out of the mother liquor; the precipitation takes place at room temperature or lower. |
| Filtration: | When tapping-off, the bottom valve under the apparatus is opened and the product is tapped off down into a suction filter. The tapped-down batch has first to sediment and, after that, the mother liquor, consisting of approximately 50% BLO/NMP and 50% water, is sucked off into the intermediate vessel, after which it is transferred into containers so that it can then be transported away to be worked up. |
| Washing: | The remaining BLO/NMP is washed away with water and conveyed to the effluent point. |
| Emptying: | The explosive in the suction filter is scooped out manually into either plastic boxes or plastic barrels and then transported away for storage and subsequent recrystallization. |

2. WORKING UP THE BLO/NMP MOTHER LIQUOR.

-continued

Description of the method for leaching returned explosive.

| | |
|---|---|
| | The working up of the ELO/NMP water takes place in two stages; firstly, the water is distilled off and then, in stage 2, the BLO/NMP is distilled off. Both these stages take place under reduced pressure. The following description presents a normal work-up. |
| Additions: | The mother liquor consisting of BLO/NMP water is collected in a distillation still. The pressure is lowered to − 95 kPa using a vacuum pump. |
| Heating: | The temperature in the still is raised using hot water or steam in the jacket of the apparatus (max 130° C.). |
| Distillation 1: | The water begins to bail at 55–60° C.; the vapor is cooled down in the condenser and collected in a receiving vessel; the water can then be tapped off to the effluent point. |
| Distillation 2: | The temperature rises in the still once there is no water left, and rises to approximately 125° C. at which point the BLO/NMP is volatilized; the distillation is continued until 10% of the spent wash remains in the still. Water is added to the remainder of the spent wash and the whole is allowed to pass to the effluent point. The volatilized BLO/NMP is tapped off into containers and is reused in the process. |
| Results: | Typical values when working up BLO/NMP: 98% BLO/NMP, 2% water. |

We claim:

1. A method for processing mixed explosives comprising binder and nitramines comprising at least one crystalline high-energy explosive selected from the group consisting of octagen and hexagen to permit reuse of at least some of the components of the mixed explosives, the method comprising:

a first leaching step for leaching out the binder with a first solvent in which the binder is soluble and in which nitrates are partially soluble, the first leaching step resulting in a mother liquor;

isolating the nitramines from the mother liquor;

dissolving the nitramines in a second solvent;

filtering solids in the second solvent; and isolating the nitramines dissolved in the second solvent for reuse.

2. The method according to claim 1, wherein the first leaching is carried out at room temperature.

3. The method according to claim 1, wherein the first leaching is carried out at a temperature above room temperature.

4. The method according to claim 1, wherein the first leaching is carried out at a temperature of about 105° C.

5. The method according to claim 1, wherein the first leaching is carried out at a temperature greater than about 105° C.

6. The method according to claim 1, wherein the first solvent dissolves at least one of explosive binders and non-explosive binders.

7. The method according to claim 1, wherein the first solvent dissolves trotyl binders.

8. The method according to claim 1, wherein the first solvent dissolves plastic or wax binders.

9. The method according to claim 1, wherein the first solvent is toluene.

10. The method according to claim 1, wherein the first solvent is xylene.

11. The method according to claim 1, wherein the mixed explosives comprise at least one of explosive binders and non-explosive binders.

12. The method according to claim 1, wherein the mixed explosives comprise trotyl binders.

13. The method according to claim 1, wherein the mixed explosives comprise plastic or wax binders.

14. The method according to claim 1, wherein the nitramines are isolated by precipitation.

15. The method according to claim 14, wherein the nitramines are precipitated by altering a degree of saturation of the solution of the second solvent and the nitramines.

16. The method according to claim 15, wherein the degree of saturation of the solution is controlled to control the shape and size of crystals of the nitramines.

17. The method according to claim 1, wherein isolating the nitramines comprises filtering the nitramines from the mother liquor.

18. The method according to claim 1, further comprising:

isolating the binder from the mother liquor after isolating the nitramines from the mother liquor.

19. The method according to claim 18, wherein isolating the binder comprises filtering the binder from the mother liquor.

20. The method according to claim 1, further comprising:

collecting the binder by distilling off the first solvent in the mother liquor.

21. The method according to claim 20, further comprising:

condensing the first solvent distilled from the mother liquor for reuse in the first leaching step.

22. The method according to claim 1, further comprising:

purifying the second solvent; and reusing the purified second solvent.

23. The method according to claim 22, wherein the second solvent is purified by distillation.

24. The method according to claim 1, wherein octagen is recovered from a mixed explosive starting material comprising octagen contaminated with an unknown quantity of hexagen or a quantity of hexagen that exceeds current standards, the recovered octagen having a degree of purity that meets the standards, and wherein the method further comprises an intermediate step performed on the nitramines removed from the mother liquor prior to dissolving the nitramines in the second solvent, the intermediate step comprising a second leaching step for leaching the nitramines in the second solvent, a precipitation step carried out under conditions such that the hexagen remains dissolved in the second solvent, and filtering off the precipitate, which comprises the nitramines dissolved in the second solvent.

25. The method according to claim 1, wherein the second solvent includes at least one of gamma-butyrolactone and N-methyl-2-pyrrolidone.

26. The method according to claim 24, wherein the second solvent includes at least one of gamma-butyrolactone and N-methyl-2-pyrrolidone.

27. A method for processing mixed explosives comprising binder and nitramines comprising at least one crystalline high-energy explosive selected from the group consisting of octagen and hexagen to permit reuse of at least some of the components of the mixed explosives, the method comprising:

a first leaching step for leaching out the binder with a first solvent in which the binder is soluble and in which nitramines are partially soluble, the first leaching step resulting in a mother liquor;

filtering the mother liquor to remove the nitramines;

precipitating the binder dissolved in the mother liquor;

collecting the binder by distilling off the solvent in the mother liquor;

condensing the solvent distilled from the mother liquor for reuse in the first leaching step;

dissolving the nitramines in a second solvent;

filtering solids in the second solvent;

precipitating the nitramines dissolved in the second solvent for reuse;

purifying the second solvent by distillation; and reusing the purified second solvent.

* * * * *